US009032758B2

(12) United States Patent
Singh et al.

(10) Patent No.: US 9,032,758 B2
(45) Date of Patent: May 19, 2015

(54) RING PROTECTION DEVICE

(71) Applicants: Himanshu Singh, Mountain View, CA (US); Kaushik Lakshmi Vinjamur, San Bruno, CA (US)

(72) Inventors: Himanshu Singh, Mountain View, CA (US); Kaushik Lakshmi Vinjamur, San Bruno, CA (US)

( * ) Notice: Subject to any disclaimer, the term of this patent is extended or adjusted under 35 U.S.C. 154(b) by 0 days.

(21) Appl. No.: 14/205,922

(22) Filed: Mar. 12, 2014

(65) Prior Publication Data

US 2014/0260426 A1 Sep. 18, 2014

Related U.S. Application Data

(60) Provisional application No. 61/791,335, filed on Mar. 15, 2013.

(51) Int. Cl.
*A44C 9/00* (2006.01)

(52) U.S. Cl.
CPC ..... *A44C 9/0092* (2013.01)

(58) Field of Classification Search
CPC ..... A44C 9/009
USPC ..... 63/15.8
See application file for complete search history.

(56) References Cited

U.S. PATENT DOCUMENTS

| | | | | |
|---|---|---|---|---|
| 1,533,441 | A | | 4/1925 | Melling |
| 1,857,195 | A | | 5/1932 | Karpf |
| 1,885,930 | A | | 11/1932 | Lowy |
| 2,048,317 | A | | 7/1936 | Berman |
| 2,076,221 | A | | 4/1937 | Bradbury |
| 2,182,876 | A | | 12/1939 | Moldenhauer |
| 2,227,131 | A | | 12/1940 | Friedman |
| 2,344,136 | A | | 3/1944 | Dressen |
| 2,553,089 | A | | 5/1951 | Holder |
| 2,649,230 | A | | 8/1953 | Thompson |
| D187,813 | S | | 5/1960 | Livingston |
| 4,155,219 | A | | 5/1979 | Anderson |
| D252,618 | S | * | 8/1979 | Barr ..... D11/86 |
| 4,377,079 | A | | 3/1983 | Krueger |
| 4,916,679 | A | | 4/1990 | Agnello |
| D331,724 | S | | 12/1992 | Klein |

(Continued)

FOREIGN PATENT DOCUMENTS

| | | |
|---|---|---|
| GB | 2362310 | 11/2001 |
| GB | 2370489 | 7/2002 |

(Continued)

OTHER PUBLICATIONS

Haight Ginny, The Ring Skin, Mar. 30, 2012, http://theringskin.com/.

(Continued)

*Primary Examiner* — Jack W Lavinder
(74) *Attorney, Agent, or Firm* — Knobbe Martens Olson and Bear LLP

(57) ABSTRACT

Embodiments of the present disclosure are directed to a ring protection device. The ring protection device can have a shell layer to at least partially encase a ring. The ring protection device can have a shell layer containing a housing segment. The segments of the shell layer can be connected to other segments via a hinge mechanism. The shell segments and hinge mechanism can be configured to encase a ring and protect it from damage. The shell layer can be connected to a sealing layer to aid the ring protection functionality. The hinge mechanism can be opened and closed to insert and remove a ring into the ring protection device.

7 Claims, 10 Drawing Sheets

(56) References Cited

U.S. PATENT DOCUMENTS

| | | | |
|---|---|---|---|
| D337,543 | S | 7/1993 | Caldow |
| 5,272,682 | A | 12/1993 | Falcone |
| 5,332,135 | A | 7/1994 | Fletcher |
| D377,769 | S | 2/1997 | Roemer |
| 5,727,399 | A | 3/1998 | Bergagnini |
| 6,023,786 | A | 2/2000 | Burnett |
| 6,094,747 | A | 8/2000 | Malick |
| 6,199,730 | B1 | 3/2001 | Chisolm |
| D455,098 | S | 4/2002 | Stefanelli |
| 6,481,244 | B1 | 11/2002 | Wright |
| D491,829 | S | 6/2004 | Seifert |
| 7,654,111 | B2 | 2/2010 | Alley et al. |
| 2006/0144083 | A1 | 7/2006 | Layton |
| 2014/0002239 | A1* | 1/2014 | Rayner ..... 340/5.61 |

FOREIGN PATENT DOCUMENTS

| | | |
|---|---|---|
| GB | 2373431 | 9/2002 |
| GB | 2377877 | 1/2003 |

OTHER PUBLICATIONS

Tokyoseven, Airsoft Canada Forum: Multicam Loadouts: Other Regions (Post 43), Apr. 6, 2012, http://www.airsoftcanada.com/showpost.php?p=825666&postcount=43.

Folcik Engineering & Design, LLC, Ring Wrapper, Apr. 6, 2012, http://www.ringwrapper.com/.

* cited by examiner

RING PROTECTION DEVICE

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND

1. Field

The present disclosure generally relates to ring protection devices which can be used to at least partially encase a user's ring.

2. Description of the Related Art

For a large number of people, a ring carries a high amount of sentimental and/or monetary value. In many cases, rings are worn with a high frequency over a long period of time. It can be nearly impossible to consistently wear a ring while also preventing the ring's exposure to severe damage (via direct contact by liquid, solid, and gases) or loss. These sometimes daily activities include showering, cleaning dishes, and exercise, amongst many others. Given the value of a ring, owners often times either decide to keep the ring on, exposing the ring to further damage. In the alternative, if the user decides to frequently remove the ring from their hand in order to avoid damage, the ring is then exposed to a higher likelihood of loss. In fact, there are at least hundreds of thousands of individuals that purchase insurance policies to protect against damage and/or loss to their rings for this exact reason.

SUMMARY

Disclosed herein in certain embodiments is a ring protection device. In some embodiments, the ring protection device can comprise a shell configured to at least partially encase a ring, and a hinge mechanism configured to move the shell between an open position and closed position.

In some embodiments, the shell can be formed of a rigid material. In some embodiments, the shell can include a clasp mechanism to strengthen the shell when in the closed position. In some embodiments, the ring protection device can further comprise a tracking device mechanism. In some embodiments, the shell can completely engulf the entire ring.

Also disclosed herein is a ring protection device for protecting a ring worn on a human finger which can comprise a shell configured to at least partially encircle the ring when the ring is being worn, and a sealing layer connected to the shell, wherein said sealing layer is configured to contact human skin in order to reduce liquid access to the ring when the ring is being worn.

In some embodiments, the shell can be formed of a rigid material. In some embodiments, the shell can be configured to not contact the ring.

In some embodiments, the ring protection device can further comprise a hinge mechanism configured to move the shell between an open position and closed position. In some embodiments, the ring protection device can further comprise a clasp mechanism to strengthen the shell when in the closed position.

In some embodiments, said shell can comprise a housing compartment which can be configured to protect a portion of the ring that houses one or more primary stones of the ring. In some embodiments, said housing compartment can be removable from a rest of the shell. In some embodiments, the housing compartment can be a first housing compartment, and the first housing compartment can be replaceable with a second housing compartment. In some embodiments, the first housing compartment can have a size or a material that is different from a size or a material of the second housing compartment.

Also disclosed herein is a ring protection device for protecting a ring worn on a human finger which can comprise a shell configured to at least partially encircle the ring while it is being worn, the shell comprising a housing compartment configured to protect a portion of the ring that houses one or more primary stones of the ring, and a sealing layer connected to the shell, wherein said sealing layer is configured to contact human skin in order to reduce liquid access to the ring.

In some embodiments, said sealing layer can be further configured to prevent movement of the ring protection device on the user's finger due to activity or outside contact.

DETAILED DESCRIPTION

Some embodiments described herein relate to a ring protection device for protecting a person's ring during active or passive conduct or activities. Some embodiments allow the user to protect people and/or fragile material from the sharp edges of the user's ring. Some embodiments relate to a ring protection device that allows a ring owner to protect and/or track his or her ring while not wearing it. Some embodiments allow the ring protection device to be easily put on by one hand of a user.

Embodiments of a ring protection device that may be worn by an individual in order to protect the ring and gem from being damaged, dinged, scratched, or lost, especially during active conduct, are disclosed herein. Embodiments of the disclosed ring protection device can effectively protect the ring from outside contact while simultaneously limiting liquid, such as grease, water, and other liquid chemicals, from entering its perimeter. In some embodiments, the device can have liquid, air, or powder tight sealing. Embodiments of the ring protection device can also be designed to fit comfortably on the user's finger, even during movement based activities. Further, embodiments of the ring protection device can be configured to generally stick on a user's finger, so it doesn't come off during showering or sweating.

Embodiments of the disclosed ring protection device can be used to protect and/or track a ring when the user removes it from his or her finger. Embodiments of the ring protection device can prevent the loss of the ring by alarming (e.g. lights, sounds, or vibration) the user when the ring is a specific distance away and can also prevent damage by protecting the rim from undesired contact. This may be advantageous to deter theft of the device, and therefore the ring.

Described herein are various embodiments of a ring protection device that greatly decreases the risk of damage or loss to a ring, and often times, a valuable ring. The ring can be an annulus. Furthermore, the ring can be a jewelry ring made from various materials such as gold, platinum, silver, jewels, crystals, and stones.

Figure 1A:
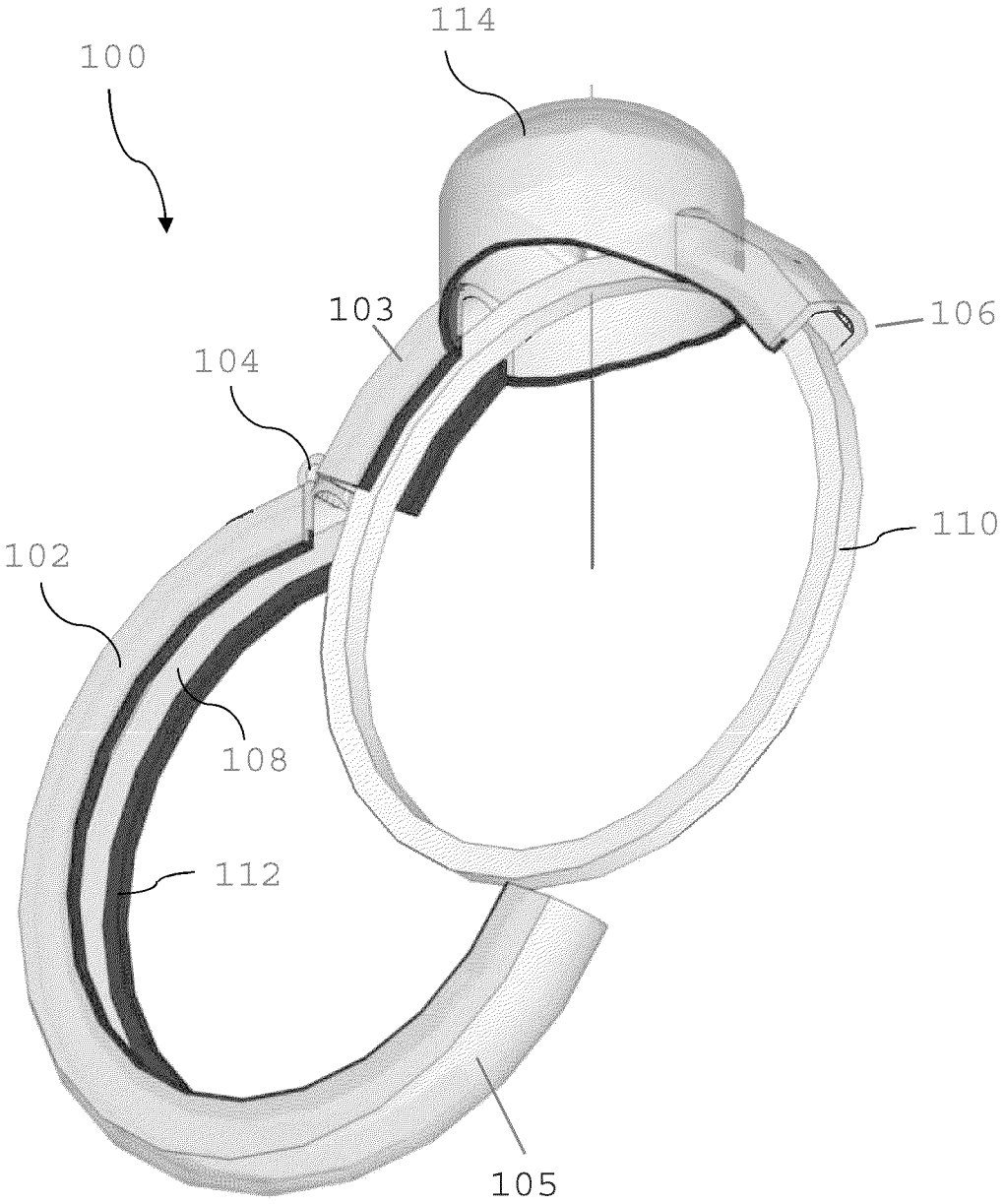
FIGS. 1A-C illustrate perspective views of an embodiment of a ring protection device.
Figure 1B:
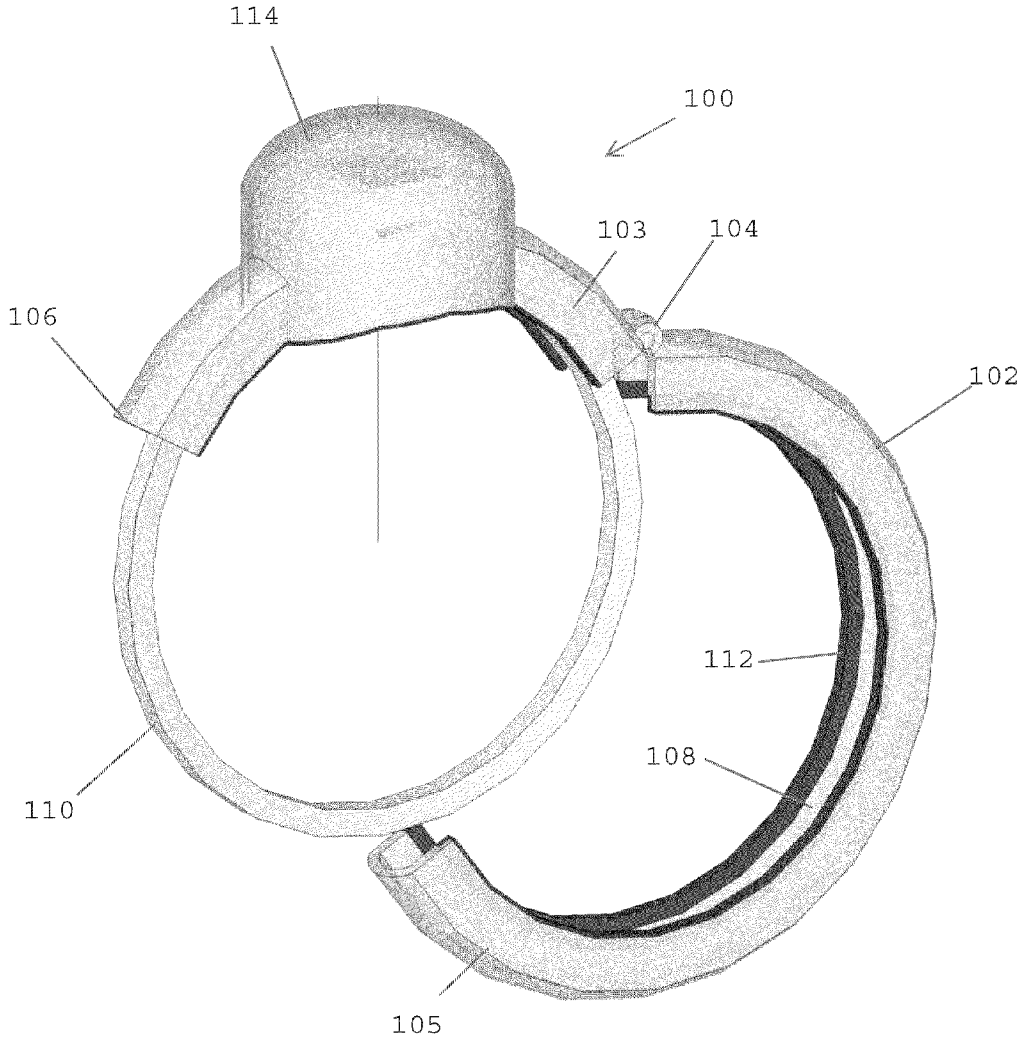
Figure 1C:
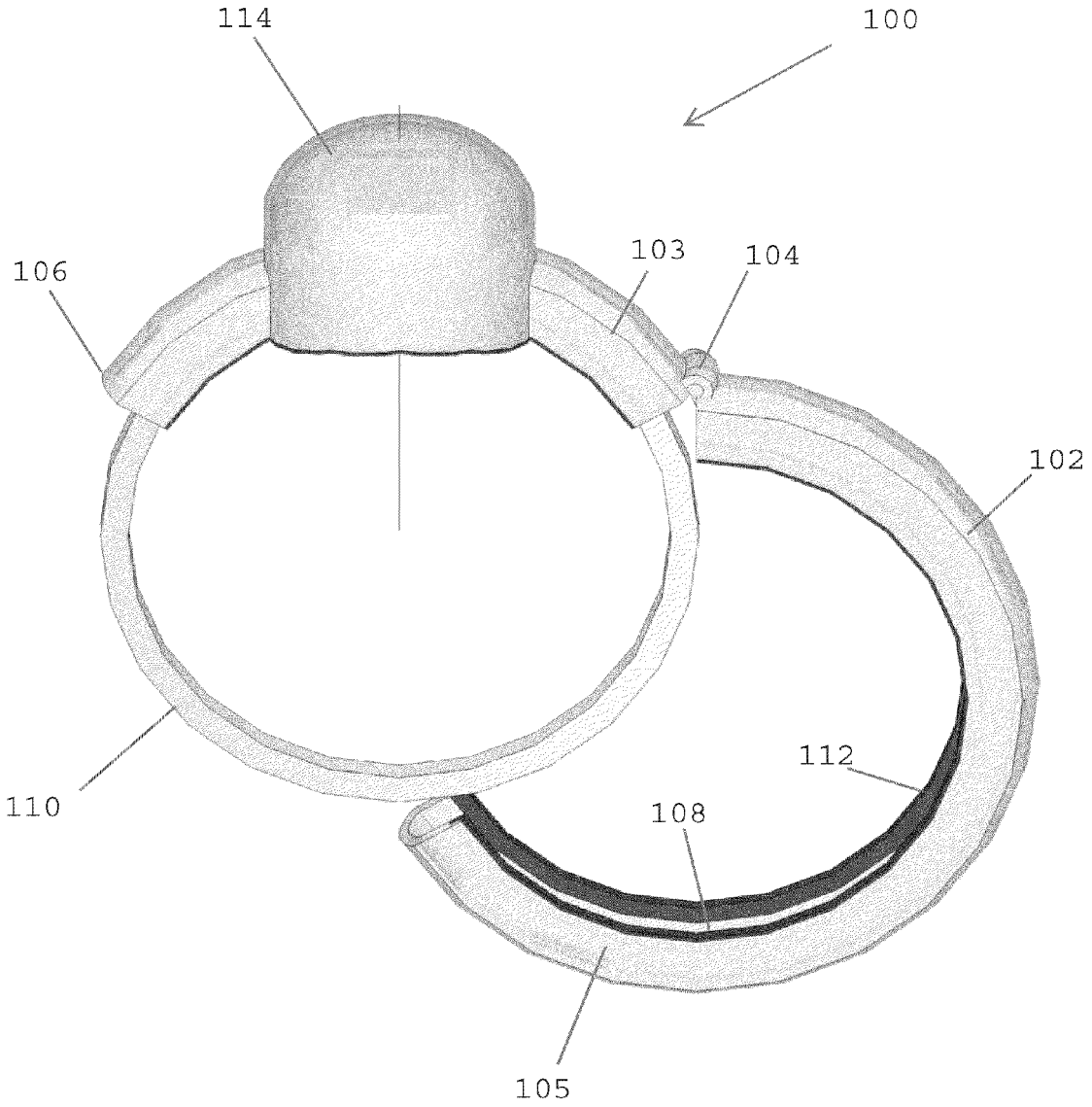

FIGS. 1A-C show an embodiment of a ring protection device 100. The ring protection device 100 can include a shell, casing or layer 102. The shell 102 can be made from a protective material, such as plastic, metal or ceramic, though the type of material is not limiting. In some embodiments, the protective material can be rigid or semi-rigid such that the shell does not substantially deform under a load. In some embodiments, the protective material can have slight give to absorb impacts. For example, protective material can have an elastic modulus of at least 1 GPa, though the elastic modulus is not limiting. Furthermore, the protective material can have a relatively high hardness, though the hardness is not limiting. In some embodiments, the protective material can also be transparent or translucent. In some embodiments, the protective material can be opaque. In some embodiments, the protective material can be transparent/translucent in some portions and opaque in other. In some embodiments, shell 102 can completely, substantially, or at least partially encircle, encase, encapsulate or cover the ring 110. For example, the shell 102 can be an annulus or generally annular, and the shape of the shell 102 is not limiting. The annulus may be continuous or may not be continuous.

Some embodiments of the ring protection device 100 include a hinge 104 and/or clasp mechanism 106 that aids the device 100 in moving back and forth from an open to closed position. For example, the annulus may have gaps, breaks or discontinuities. The annulus may have two or more discontinuities to form two or more segments of the annulus. The segments can be separate components. The segments can be coupled together with a hinge 104 and/or clasp mechanism 106. For example, a hinge 104 can be coupled to a first segment 103 and a second segment 105 at a discontinuity so that the first 103 and second segments 105 can rotate about the discontinuity. A clasp mechanism 106 can be coupled to a first segment 103 adjacent to a discontinuity and the clasp mechanism 106 can be removably coupled to a second segment 105 to lock and unlock the first and second segment 103/105 together. The hinges 104 and clasp mechanisms 106 can be used interchangeably on the device 100, and the position and attachment parts are not limiting.

The shell 102 can have an opening or slot 108 on an inside of the shell 102. In some embodiments, the shell 102 can have an annular dome shape. In some embodiments, the shell 102 can have an annular slot 108 on an inside of the annular shell 102. The slot 108 can be sized to have a ring 110 disposed therein, though the size is not limiting. In some embodiments, the slot 108 can contain at least one lock clip to hold a ring 110 in place.

The ring protection device 100 can include a sealing layer 112 coupled to the shell 102. The coupling of the sealing layer 112 to the device 100 is not limiting and mechanical and/or chemical coupling can be used. In some embodiments, the sealing layer 112 can be adjacent to the slot 108. For example, the sealing layer 112 can be on an inner most surface of the shell 102. As such, the sealing layer 112 can be sandwiched between the shell 102 and a user's finger and/or can be sandwiched between the shell 102 and the ring 110. Furthermore, the sealing layer 112 can be adjacent to both sides of the slot 108. Therefore, the sealing layer 112 can include two separate portions. In some embodiments, the sealing layer 112 can be substantially continuous around the annulus of the shell 102. Thus, the sealing layer 112 can be an annulus, or generally an annulus. In some embodiments, the sealing layer 112 may not be substantially continuous around the annulus of the shell 102. The sealing layer 112 can be configured to reduce liquid access to the ring 110. Thus, in use, the slot 108 can be substantially fluidly (e.g., liquidly) isolated from outside of the shell 102. The sealing layer 112 can be formed from a material that can elastically deform to provide a good seal between the shell 102 and the user's finger. For example, the sealing layer 112 can be a polymer, rubber, foam, or foam-like material, and the type of material is not limiting. Furthermore, the sealing layer 112 can be adapted to function with the hinge 104 and/or clasp mechanism 106 (e.g., fasteners). For example, the sealing layer 112 can have discontinuities similar to that of the shell 102.

The shell 102 can also include a housing compartment 114 configured to encircle, encase, encapsulate or cover a portion of the ring 110 that houses one or more stones. Since the portion of the ring 110 that houses the stone tends to be larger than the rest of the ring 110, the housing compartment 114 can be larger (e.g. thicker, wider, and/or taller) than the rest of the shell 102. Furthermore, as described above, the sealing layer 112 can also be attached to the housing compartment 114 of the shell 102. The housing compartment 114 can be configured to be separated from the rest of the shell 102.

The ring protection device 100 can also include a protecting layer configured to contact the ring 110. For example, the protecting layer can be within the slot 108 and/or the housing compartment 114. The protecting layer can be or formed from foam, foam-like material, shape-memory foam, or elastic material, though the type of material is not limiting. The protecting layer may deform to form fit to the ring 110.

The ring protection device 100 can be symmetrical or asymmetrical. For example, some users may wear the ring 110 adjacent to or near a knuckle. The ring 110 may be configured to be worn adjacent to or near a knuckle of the user's finger. For example, the ring protection device 100 may be asymmetrical such that a side of the ring protection device 100 (e.g., shell 102, sealing layer 112) closest to the user's knuckle may be configured and/or shaped differently than a side of the ring protection device 100 furthest form the user's knuckle. Other portions of the ring protection device 100 may be asymmetrical such as to conform to a finger.

The ring protection device 100 can also include one or more light bulbs, such as LEDs (light emitting diodes) or fluorescence, in order to help see both the ring protection device 100 and the ring 110 itself. The number and type of light bulbs is not limiting.

The ring protection device 100 can be used to encase the ring 110 while the user is not wearing the ring 110. The ring protection device 100 can include one or more tracking devices, such as GPS, to help the user keep track of the location of his or her ring 110. The type of tracking device is not limiting.

Figure 2A:
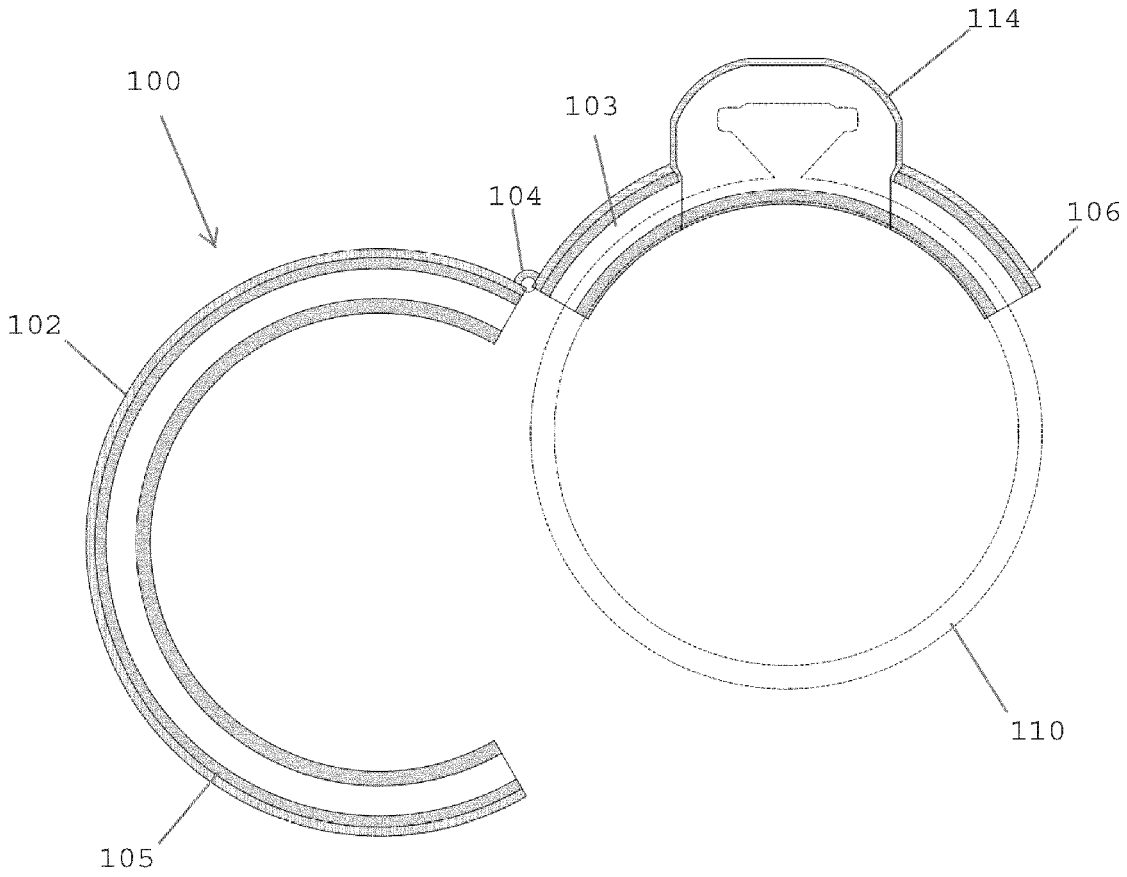
FIGS. 2A-E illustrate an embodiment of a ring protection device in different positions and from different points of view.

FIG. 2A shows a front cross-sectional view of an embodiment of a ring protection device 100 in an open position with a hinge mechanism incorporating a single hinge 104.

Figure 2B:
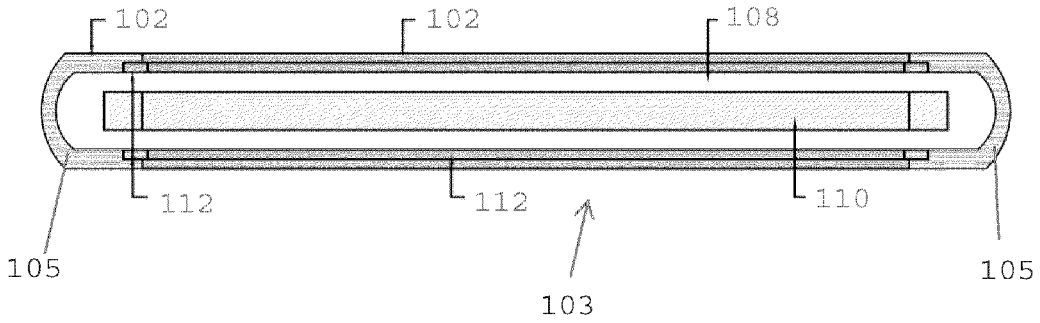

FIG. 2B shows a side cross-sectional view of an embodiment of a ring protection device 100 shown in FIG. 2A in which neither the shell 102 nor the sealing layer 112 contacts the user's ring band.

Figure 2C:
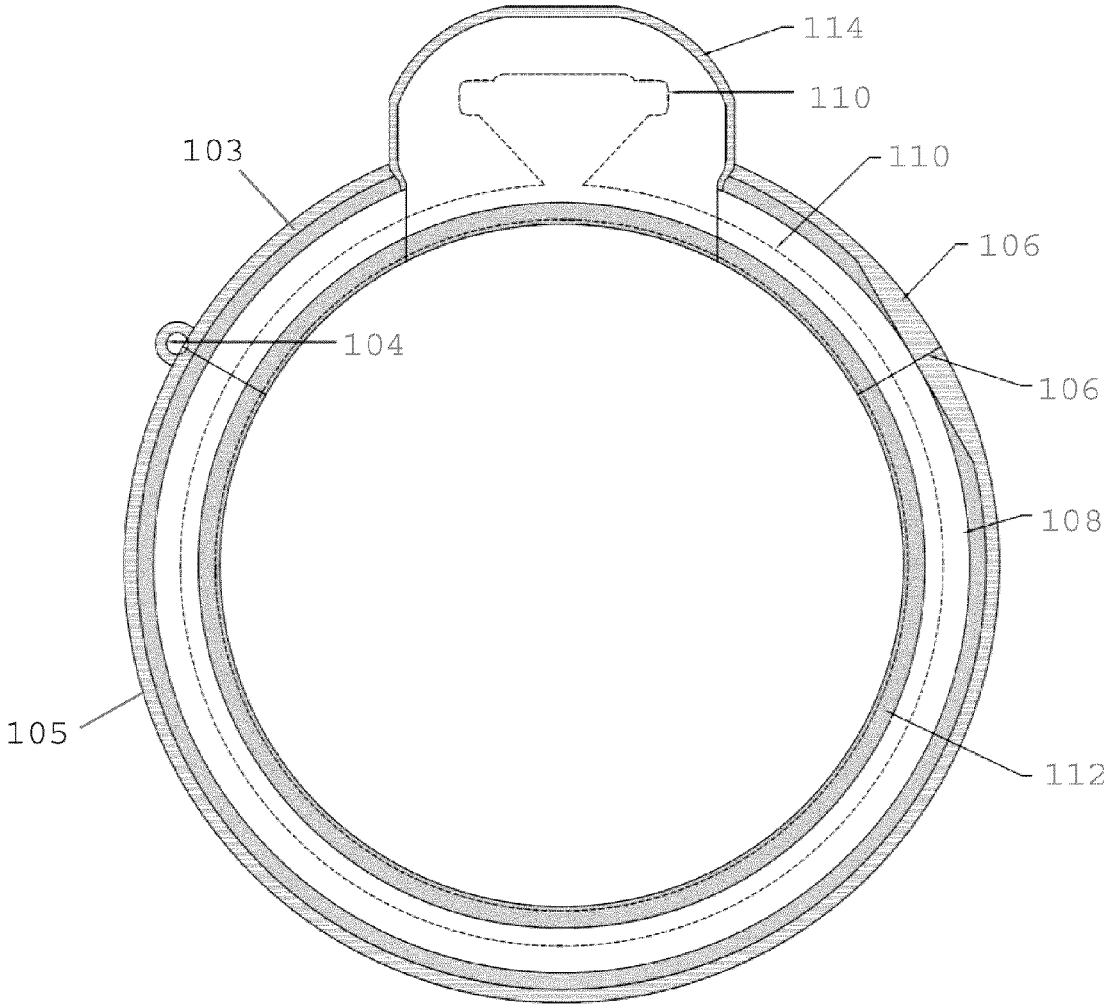

FIG. 2C shows the front cross-sectional view of an embodiment of a ring protection device 100 shown in FIG. 2A in which the shell 102 is in a closed position and is configured to contact the ring band for further stability.

Figure 2D:
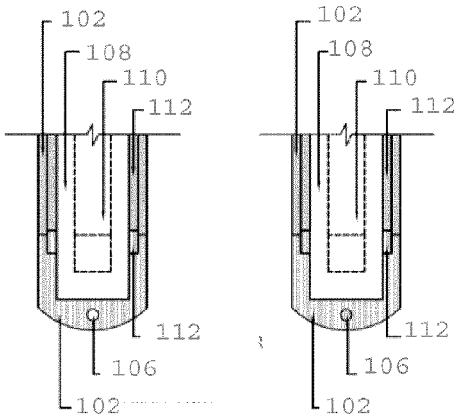

FIG. 2D shows a cross sectional view of an embodiment of a ring protection device 100 that uses one possible type of a clasp mechanism 106 with a male and female end. The female clasp end is shown as 106 on the left, and the male clasp end is shown as 106 on the right. The female clasp end could be located on either the first segment 103 or the second segment 105, and the male clasp end could be located on the opposite segment as the female clasp end.

Figure 2E:
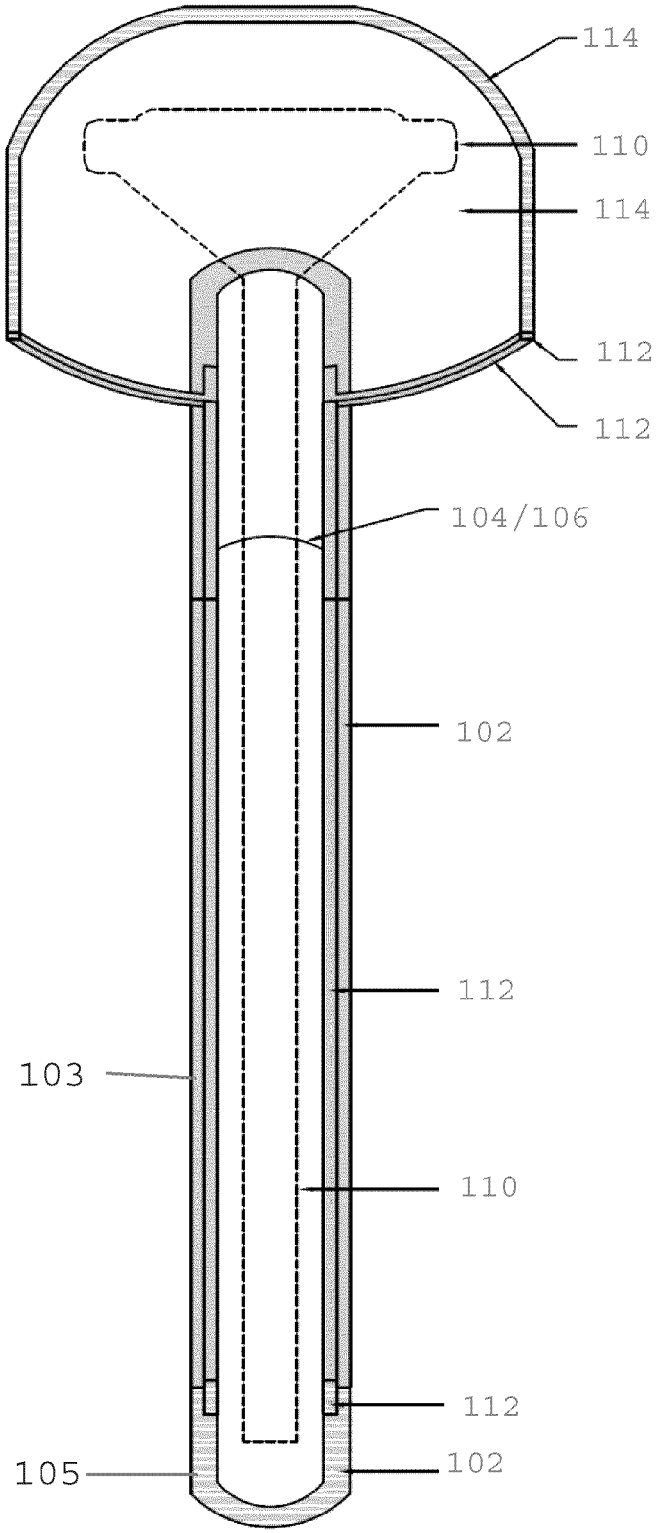

FIG. 2E shows a side cross-sectional view of an embodiment of a ring protection device 100 with a hinge 104 or clasp 106 line when the device is in the closed position. As the cross section segment cuts down the center of device 100, the lighter gray shade in FIG. 2E indicates an actual cut through of device 100, while the dark shade indicates a side view of device 100 which is not a cut through.

Figure 3A:
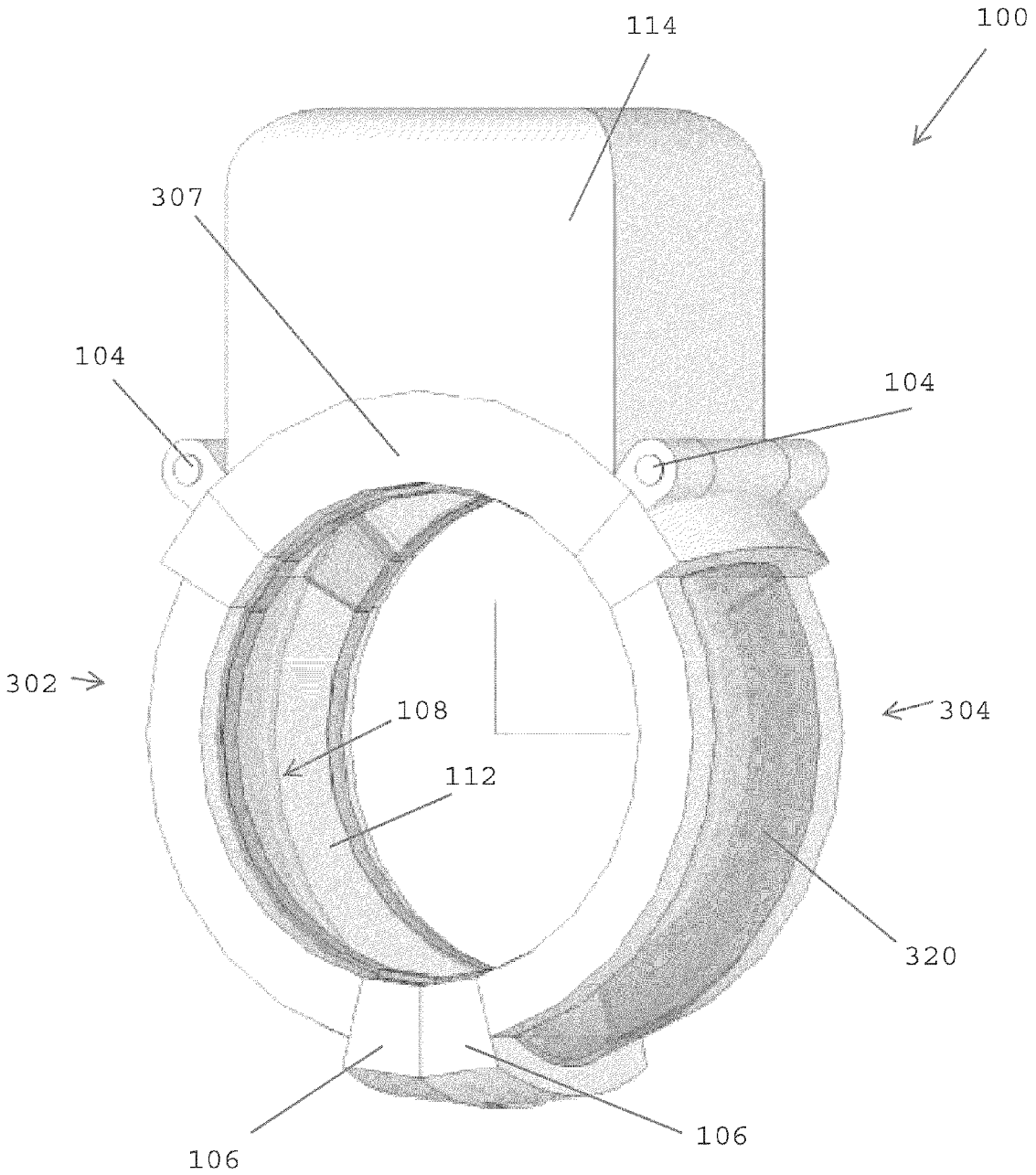
FIGS. 3A-D illustrate components of an embodiment of a ring protection device in different positions and from different points of view.
Figure 3B:
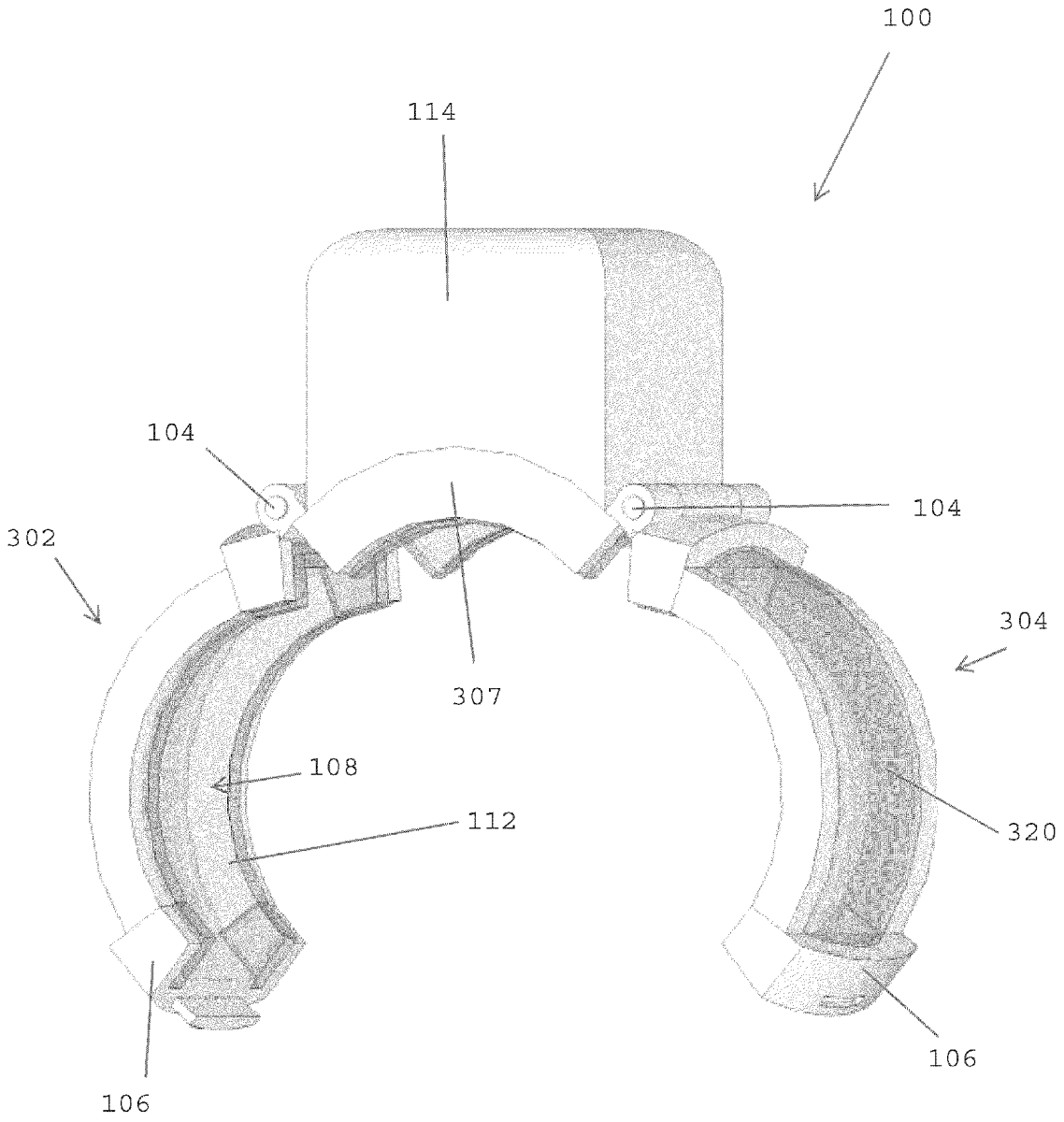

FIGS. 3A-D show a further embodiment of a ring protection device 100. As shown in FIGS. 3A-B, and described above, the ring protection device 100 can have a generally annular shape. FIG. 3A illustrates an embodiment of a ring protection device 100 in a closed configuration. FIG. 3B illustrates an embodiment of the ring protection device 100 of FIG. 3A in an open configuration. As shown, in some embodiments the shell 102 can be split into three segments 302, 304, and 307. In some embodiments, the shell 102 can be split into more than three segments, and the number of segments is not limiting. Each of segments 302/304 can attach to housing segment 307 which can be connected to the housing compartment 114. In some embodiments, the segments 302/304 can then attach to one another through a clasp mechanism 106. In some embodiments, the clasp mechanism 106 can be part of segments 302/304. As shown in FIG. 3B, where the device 100 is opened, both segments 302/304 can rotate away from each other. Accordingly, a ring 110 can be inserted through the opened clasp mechanism 106 and inserted into slot 108. In some embodiments, the segments 302/304 can rotate about hinges 104 so that they are generally about 90, 100, 110, 120, 130, 140, 150, 160, 170, or 180° apart, though this angle is not limiting. In some embodiments, each of the segments 302/304/307 can be generally ¼ of a circle, ½ of a circle, or ¾ of a circle.

In FIGS. 3A-B, the segments 302/304 contain a gap 320 in the shell 102. The underlying sealing layer 112 can fill the gap 320 in the shell 102 and/or segments 302/304. In some embodiments, the segments 302/304 can extend fully around the outside of the sealing layer 112 and eliminate the gap 320. Accordingly, in some embodiments the sealing layer 112 may not be visible when the ring is in the closed position on a finger. In some embodiments, the sealing layer 112 can extend over the edge of the clasp mechanism 106. In some embodiments, the sealing layer 112 can be thicker in some portions of the device 100 and thinner in others. For example, the sealing layer 112 can be thinner below the housing compartment 114 than around the segments 302/304 approximately 90° away in the closed position.

Figure 3C:
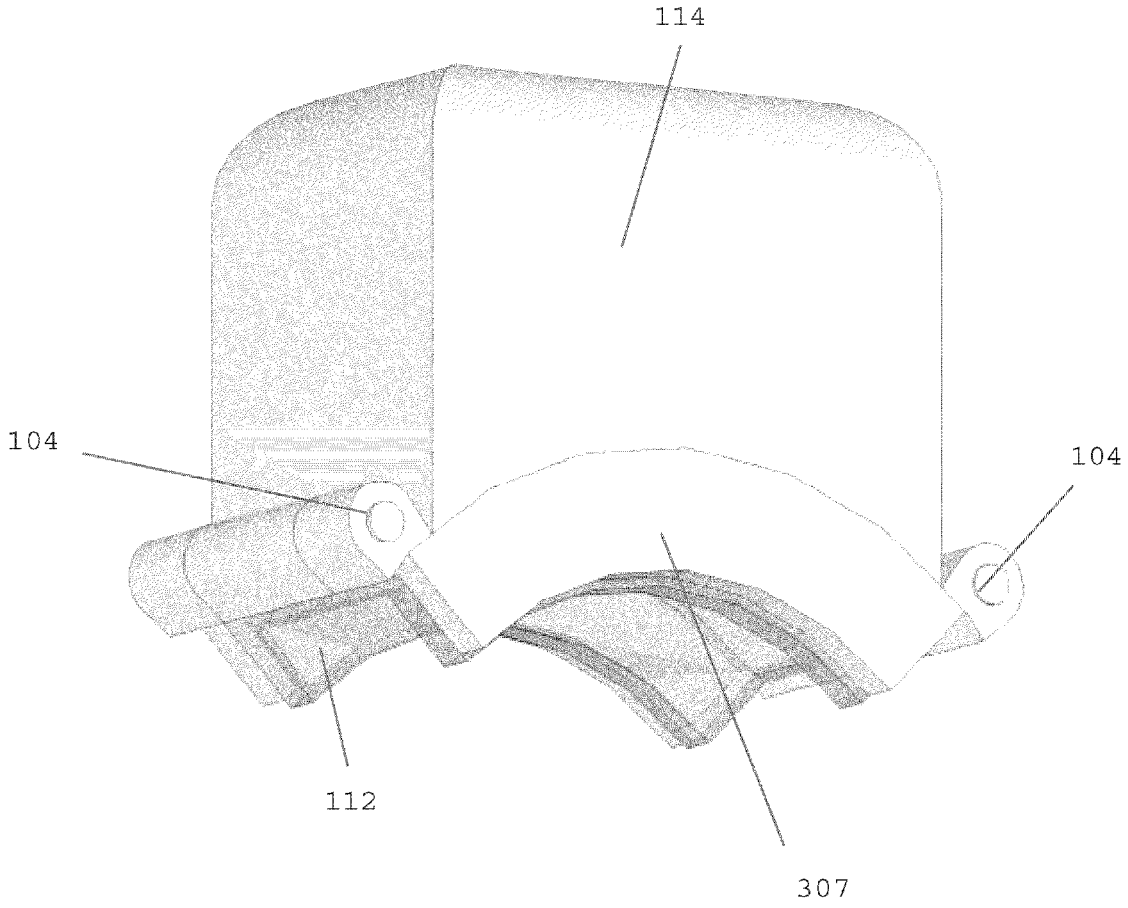
Figure 3D:
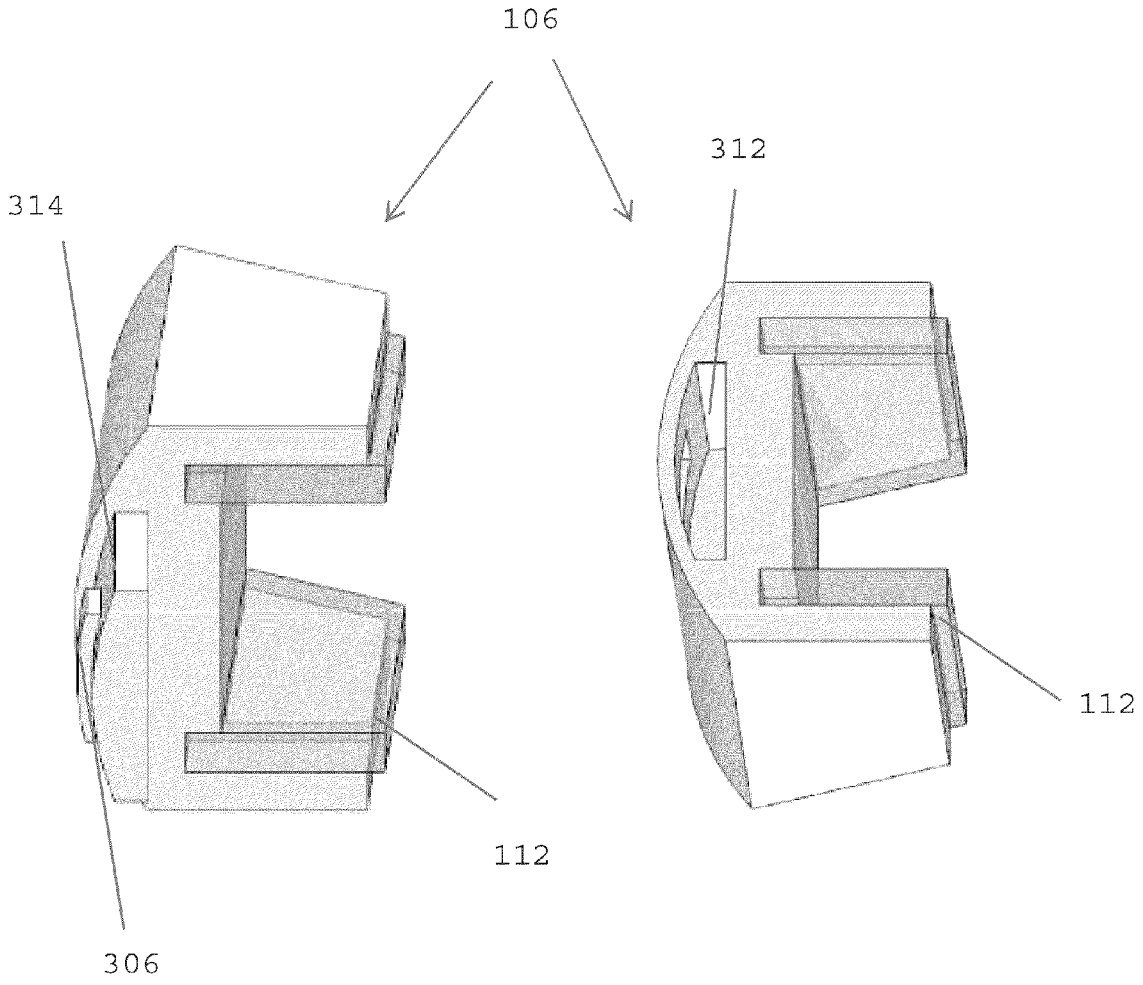

FIGS. 3C-D illustrate more detailed viewpoints of different components of embodiments of ring protection device 100.

FIG. 3C illustrates an embodiment of a housing segment 307 having a pair of hinges 104 located underneath the housing compartment 114. In some embodiment, the hinges 104 can be generally snap hinges, configured to remain in certain locations, though the type of hinge 104 is not limiting. In some embodiments, the housing segment 307 can contain a sealing layer 112. In some embodiments, the housing compartment 114 can be generally centered between hinges 104. In some embodiments, the housing compartment 114 is not centered between hinges 104. In some embodiments, other types of rotational connections can be used between segment 307 and segments 302/304, and the type or means of rotation is not limiting. In some embodiments, the sealing layer 112 in the housing segment 307 and segments 302/304 can overlap when the hinges 104 are closed, thereby creating a generally seamless 360 degree seal on a user's finger.

In some embodiments, the housing compartment 114 can be decorated to include colors or patterns. In some embodiments, the housing compartment 114 can be generally rectangular shaped. However, the shape of the housing compartment 114 is not limiting. For example, the housing compartment 114 can be generally round, generally circular shaped, or generally triangular shaped. In some embodiments, the housing compartment 114 can be configured to retain a specific sized stone on a ring 110. In some embodiments, the housing compartment 114 can have generally smooth corners so as not to injure a user. In some embodiments, the housing compartment 114 can be configured to fit within the hinge 104, as shown in FIGS. 3A-B. In some embodiments, the inside of the housing compartment 114 can contain the sealing layer 112 to protect a ring 110. In some embodiments, the housing compartment 114 can be integrally formed with the housing segment 307. In some embodiments, the housing compartment 114 can be attached, either removably or non-removably, from the housing segment 307. In some embodiments, the shell 102 can consist of the housing segment 307 only, and can be attached or molded to a sealing layer 112 that can wrap up to 360 degrees around the user's finger. In some embodiments, the shell 102 can be attached (e.g., overmolded) directly to the sealing layer 112 with the use of a hinge 104 or a clasp 106. The attachment technique is not limiting. In yet other embodiments, the shell 102 can consist of segments 302/304 only, and can be attached or molded to a sealing layer 112 that can wrap up to 360 degrees around the user's finger.

FIG. 3D illustrates an embodiment of a clasp 106. In some embodiments, the clasp 106 is a portion of a larger segment (see segments 302/304 in FIG. 3A). In some embodiments, the clasp 106 can also be its own segment. As shown, the clasp can contain a button 306, or other actuating mechanism, which can release the clasp 106. The clasp 106 can contain a male 314 and female 312 component. The button 306 can be located on either component. In some embodiments, the female component 312 can be configured to receive and retain the male component 314. However, a person having skill in the art would understand that different configurations of clasps could be used, such as those including hooks, magnetics, or frictional holding, and the type of clasp is not limiting. In some embodiments, the sealing layer 112 in the segments 302/304 can extend into the clasp 106 and can overlap when the clasp 106 is closed, thereby creating a generally seamless seal on a user's finger.

Some embodiments have been described in connection with the accompanying drawings. The figures are drawn to scale, but such scale should not be limiting, since dimensions and proportions other than what are shown are contemplated and are within the scope of the disclosed inventions. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, it will be recognized that any methods described herein may be practiced using any device suitable for performing the recited steps.

While various embodiments of the innovation have been described, it will be apparent to those of ordinary skill in the art that many more embodiments and implementations are possible within the scope of the innovation. Accordingly, the innovation is not to be restricted except in light of the attached claims, or claims that may be presented in the future, and their equivalents.

What is claimed is:

1. A ring protection device for protecting a ring worn on a human finger comprising:

a shell configured to at least partially encircle the ring when the ring is being worn;

a removable housing compartment configured to attach to the shell and configured to protect a portion of the ring that houses one or more primary stones of the ring, wherein said removable housing compartment is removable from the shell;

a first sealing layer connected to the shell, wherein said first sealing layer is configured to contact human skin in order to reduce liquid access to the ring when the ring is being worn; and a perimeter sealing layer located within the removable housing, wherein said perimeter sealing layer is configured to create a seal with the first sealing layer upon attachment of the removable housing to the shell.

2. The ring protection device of claim 1, wherein the shell is formed of a rigid material.

3. The ring protection device of claim 1, wherein the shell is configured to not contact the ring.

4. The ring protection device of claim 1, further comprising a hinge mechanism having at least two hinges, the hinge mechanism configured to move the shell between an open position and closed position.

5. The ring protection device of claim 4, further comprising a clasp mechanism to strengthen the shell when in the closed position.

6. The ring protection device of claim 1, wherein the removable housing compartment is a first removable housing compartment, and the first removable housing compartment is replaceable with a second removable housing compartment.

7. The ring protection device of claim 6, wherein the first removable housing compartment has a size or a material that is different from a size or a material of the second removable housing compartment.

* * * * *